US007677570B2

(12) United States Patent
Hohenstein et al.

(10) Patent No.: US 7,677,570 B2
(45) Date of Patent: Mar. 16, 2010

(54) COMPETITIVE SUDOKU BOARD GAME

(76) Inventors: Michael Hohenstein, 4435 Penn St., Philadelphia, PA (US) 19124; John F. Hohenstein, 4435 Penn St., Philadelphia, PA (US) 19124

( * ) Notice: Subject to any disclaimer, the term of this patent is extended or adjusted under 35 U.S.C. 154(b) by 171 days.

(21) Appl. No.: 11/622,913

(22) Filed: Jan. 12, 2007

(65) Prior Publication Data

US 2007/0176362 A1 Aug. 2, 2007

Related U.S. Application Data

(60) Provisional application No. 60/763,215, filed on Jan. 30, 2006.

(51) Int. Cl.
*A63F 9/00* (2006.01)

(52) U.S. Cl. ..... 273/271; 273/153 R

(58) Field of Classification Search ..... 273/240, 273/260, 261, 264, 267, 271, 153 R
See application file for complete search history.

(56) References Cited

U.S. PATENT DOCUMENTS

| | | | | |
|---|---|---|---|---|
| 3,588,112 | A | 6/1971 | Holt | |
| 3,747,932 | A | 7/1973 | Grissino | |
| 4,131,281 | A | 12/1978 | Taylor | |
| 4,541,634 | A | 9/1985 | Nolan | |
| 4,569,528 | A * | 2/1986 | Fanti | 273/267 |
| 5,286,061 | A * | 2/1994 | Behm | 283/95 |
| 5,961,118 | A | 10/1999 | Chie et al. | |
| 6,431,547 | B1 * | 8/2002 | Arkoosh et al. | 273/275 |
| 6,581,935 | B1 * | 6/2003 | Odom | 273/269 |
| 6,702,288 | B1 * | 3/2004 | Ohman | 273/271 |
| 2005/0077681 | A1 | 4/2005 | Kowalczyk | |
| 2007/0105077 | A1 * | 5/2007 | Pechter | 434/188 |

OTHER PUBLICATIONS http://en.wikipedia.org/wiki/Sudoku, Wikipedia website, Nov. 2005.*

(Continued)

*Primary Examiner*—William M Pierce
(74) *Attorney, Agent, or Firm*—Volpe and Koenig P.C.

(57) ABSTRACT

The present invention is a board game. In a preferred embodiment, a competitive board game for two to nine players is disclosed. The game board is initialized by placing markers on the game board in a specified fashion. Distinct markers are distributed, and play progresses in turn by each player placing a marker on the game board such that each row, column, and box does not contain two identical markers. In an alternative embodiment, a board game for team play is disclosed. The board game may also be implemented in a computer or other electronic device.

10 Claims, 5 Drawing Sheets

OTHER PUBLICATIONS http://www.elversonpuzzle.com/Sudoku-Board-Game.html, Gold Spike Deluxe Sudoku, Nov. 2006.* http://boardgamegeek.com/game/21528, Sudoku—The Board Game (2005), published by Pressman Toy Corp. Dec. 2005.* http://boardgamegeek.com/game/20801, Sudoku—(2005), Imagination Entertainment Ltd. Dec. 2005.* http://www.beckysweb.co.uk/sudoku/flickrsudoku.asp, Hamster Sudoku, Sudoku using hamster picutures website, Dec. 2005.* http://colorku.com/, Colorku—The Color Sudoku Puzzle website, Sep. 2005.* http://econlog.econlib.org/archives/2005/12/twoperson$_{13}$ sudok.html, Website Electronic Color Two Person Sudoku, Library of Economics and Liberty website, Dec. 2005.* http://www.superkids.com/aweb/tools/logic/dots/, SuperKids Classic Game of Dots website, 2000.*

Wikipedia.com Article: Sudoku, http://web.archive.org/web/20050517014559/http://en.wikipedia.org/wiki/Sudoku; May 17, 2005, p. 2 para 3.

Electronic Sudoku, Sudoku Electronics, http://web.archive.org/web/20051128023634/www.sudoku-electronic-puzzles.com/sudoko.htm; Nov. 28, 2005, p. 1 para 1.

* cited by examiner

LEGEND

1 = WHITE
2 = RED
3 = ORANGE
4 = YELLOW
5 = GREEN
6 = AQUA
7 = BLUE
8 = PURPLE
9 = BLACK

LEGEND

1 = WHITE
2 = RED
3 = ORANGE
4 = YELLOW
5 = GREEN
6 = AQUA
7 = BLUE
8 = PURPLE
9 = BLACK

LEGEND

1 = WHITE
2 = RED
3 = ORANGE
4 = YELLOW
5 = GREEN
6 = AQUA
7 = BLUE
8 = PURPLE
9 = BLACK

COMPETITIVE SUDOKU BOARD GAME

CROSS REFERENCE TO RELATED APPLICATION

This application claims the benefit of U.S. Provisional Application No. 60/763,215, filed Jan. 30, 2006 which is incorporated herein by reference as if fully set forth.

FIELD OF INVENTION

The present invention generally relates to board games. More particularly, the present invention is a method and apparatus for playing a board game, as well as an implementation of the board game by an electronic device, by way of computer executable software.

BACKGROUND

A board game is any game played by placing and/or moving markers or pieces on a marked board or other demarcated surface. Relatively simple board games, such as Backgammon and Checkers, are often seen as ideal family entertainment as they provide entertainment for all ages. More complex board games such as Chess and Risk™ have well developed strategies and have become classics that are well known. In addition to entertainment value, board games that lend themselves to team play provide an opportunity for building communication skills.

In recent times, with the advent of computers and other electronic gaming consoles and the like, board games are increasingly implemented in software code for play on these electronic devices. While these games are not board games in the traditional sense, the nature of the game play remains identical to that of a traditional board game, and these electronic implementations of board games are increasingly popular.

SUMMARY

The present invention is a board game. In a preferred embodiment, a competitive board game for two to nine players is disclosed. A game board having a predetermined number of receptacles organized in rows, columns, and boxes is initialized by placing markers on the game board in a specified fashion. Distinct markers are distributed, and play progresses in turn by each player placing a marker on the game board such that each row, column, and box does not contain two identical markers. In an alternative embodiment, a board game for team play is disclosed. The board game may also be implemented in a computer or other electronic device.

BRIEF DESCRIPTION OF THE DRAWINGS

A more detailed understanding of the invention may be had from the following description of preferred embodiments, given by way of example and to be understood in conjunction with the accompanying drawings wherein.

DETAILED DESCRIPTION OF THE PREFERRED EMBODIMENTS

The present invention will now be described with reference to the drawings wherein like numerals represent like elements throughout. As used herein, the term "board game" includes, but is not limited to a board game in the traditional sense, but also a game playable on a computer or similar electronic device.

Figure 1:
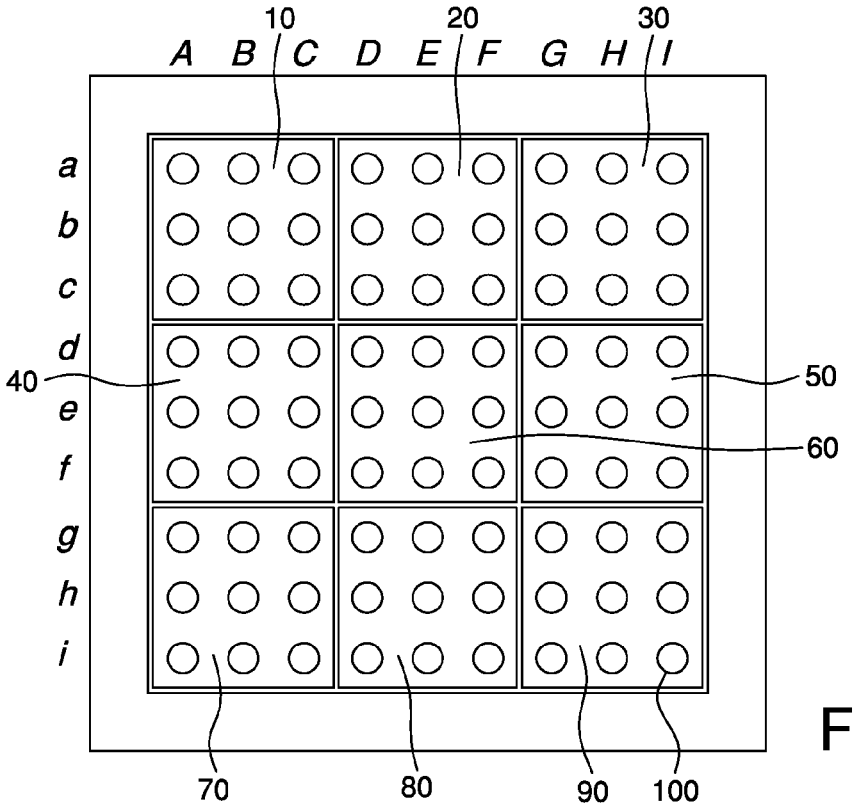
FIG. 1 is game board in accordance with the present invention.

Referring to FIG. 1, an illustration of the game board 100 of a preferred embodiment of the present invention is shown. The game board 100 is preferably a square board having eighty one (81) receptacles. The receptacles are arranged in nine (9) rows and (9) columns, and are preferably equidistant. Individual receptacles are referred to herein using the coordinate system as shown in FIG. 1. For Example, the upper left most receptacle is receptacle (A, a). The game board 100 is delineated into nine (9) regions 10, 20, 30, 40, 50, 60, 70, 80, and 90, also termed 3×3 boxes, of 9 receptacles.

The contents of the board game further include nine distinct groups of nine markers, for a total of eighty one markers; one marker for each receptacle. The distinction between groups of markers is preferably a color, but may be any distinctive treatment that distinguishes markers of a group from other markers of different groups. Where color is selected as the distinction, the eighty one markers are preferably colored as follows: nine white/clear markers, nine red markers, nine orange markers, nine yellow markers, nine green markers, nine aqua markers, nine blue markers, nine purple markers, and nine black markers, for a total of eighty one markers. In the drawing figures, color is represented by numbers 1 through 9, corresponding to colors as shown in the Legend.

The contents of the board game preferably include a pouch or other container for storing the markers. A plurality of shields, one for each player, is also included in the contents of the board game for privacy, which will be discussed in more detail below.

It should be noted that the contents and layout of the board game may be varied as desired. For example, although a game board having eighty one receptacles is presently preferred, game boards having more or less receptacles, and in turn more or less markers, would be apparent to those skilled in the art.

In a first embodiment, a turn-based multiplayer board game is disclosed that supports game play for up to nine (9) players. To determine which player will play first, a player may be chosen at random. Alternatively, the markers may be arbitrarily assigned a value, and each player may blindly choose a single marker from the pouch. The player with the lowest valued marker plays first. In the case of a tie between two player's selected markers, the process is repeated until a starting player is established. The order of game play is preferably assigned in the order the players are seated relative to the starting player, with game play preferably progressing to the starting player's left. Once the game play order is determined, any markers used for game play order determination are returned to the pouch.

Figure 2A:
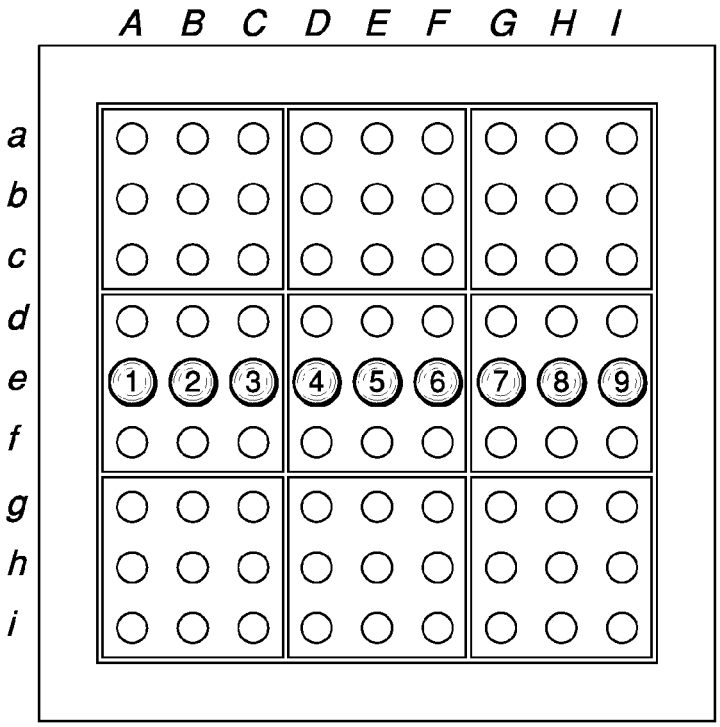
FIG. 2A is an illustration of the game board of FIG. 1 initialized for game play by placing distinctive markers in a single horizontal row according to a first embodiment of the invention.
Figure 2B:
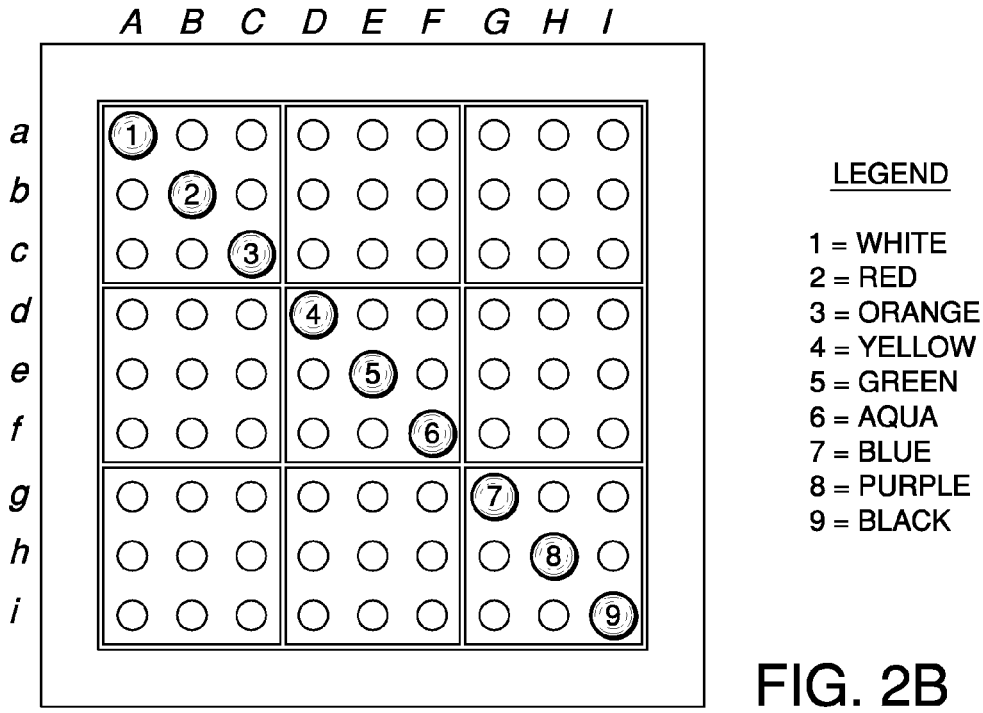
FIG. 2B is an illustration of the game board of FIG. 1 initialized for game play by placing distinctive markers along a diagonal.
Figure 2C:
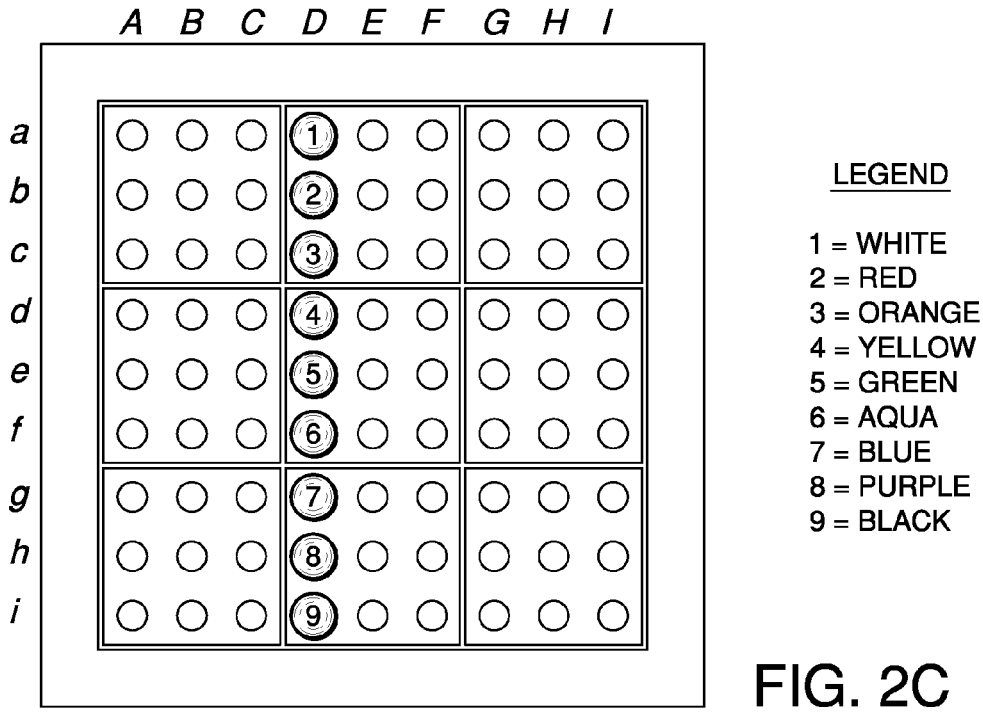
FIG. 2C is an illustration of the game board of FIG. 1 initialized for game play by placing distinctive markers in a single vertical row.

Referring to FIGS. 2A, 2B, and 2C, the game board is initialized for play by placing nine markers, one of each distinction, on the game board in any horizontal row, as shown in FIG. 2A; diagonal, as shown in FIG. 2B; or vertical row, as shown in FIG. 2C. Where the distinctive surface treatment of the markers is color, the preferred order for initializing the game board is as follows, referring to FIG. 2A: white/clear (A, e), red (B, e), orange (C, e), yellow (D, e), green (E, e), aqua (F, e), blue (G, e), purple (H, e), and black (I, e). Coincidentally, it is noted that placing the markers in this order reveals the color spectrum. The remaining seventy two markers are placed in the pouch or container.

Next, each player blindly chooses a number of stones for game play from the pouch according the number of players, as shown in Table 1. If the board game is played with 5 or 7 players, two markers will remain in the pouch after each player has selected their markers. Preferably, none of the players know which markers remain in the pouch. Additionally, it is preferred that each player maintains his or her markers secretly.

TABLE 1

Marker Distribution

| Number of Players | Number of Markers to Start |
|---|---|
| 2 Players | 36 Markers each |
| 3 Players | 24 Markers each |
| 4 Players | 18 Markers each |
| 5 Players | 14 Markers each |
| 6 Players | 12 Markers each |
| 7 Players | 10 Markers each |
| 8 Players | 9 Markers each |
| 9 Players | 8 Markers each |

The object of the board game is for a player to play as many markers as possible. The board game starts with the starting player placing a marker on the game board 100, and continues with each player doing the same in turn. The following rules apply:

1. Only one distinct marker may be played in any horizontal row, vertical column, or 3×3 box.
2. Once a player removes their hand from a marker that has been placed in a receptacle on the game board, their turn is completed.
3. If a player places a marker in any row, column, or 3×3 box, such that the row, column, or 3×3 contains one of each distinct marker, that player receives an extra turn for each row, column, and 3×3 box completed. For example, if a marker completes a row, column, or 3×3 box, the player may place one additional marker on the game board. If a marker completes both a row and a column, the player may place two additional markers on the game board. If a marker placed completes a row, column, and 3×3 grid, the player may place three additional markers on the game board. Before the extra turn is taken all players must agree that the extra turn is valid.
4. If a player places a marker on the game board in violation of rule 1, any other player may call a misplay. If this occurs, the player calling the misplay must explain why the stone cannot be placed in that position on the board. If the player calling the misplay is correct, the misplayed marker is removed from the game board and returned to the player who misplayed it. The player who misplayed the marker may not place another marker on the game board. If the player calling the misplay is incorrect, as determined by the remaining players, then that player forfeits their next turn. If a misplay is not caught before the next completed turn, then the misplayed marker remains on the game board, thus preventing certain rows, columns, or 3×3 boxes from being eligible for an extra turn.
5. If a player is unable to play any of their markers, they must pass.

Figure 3:
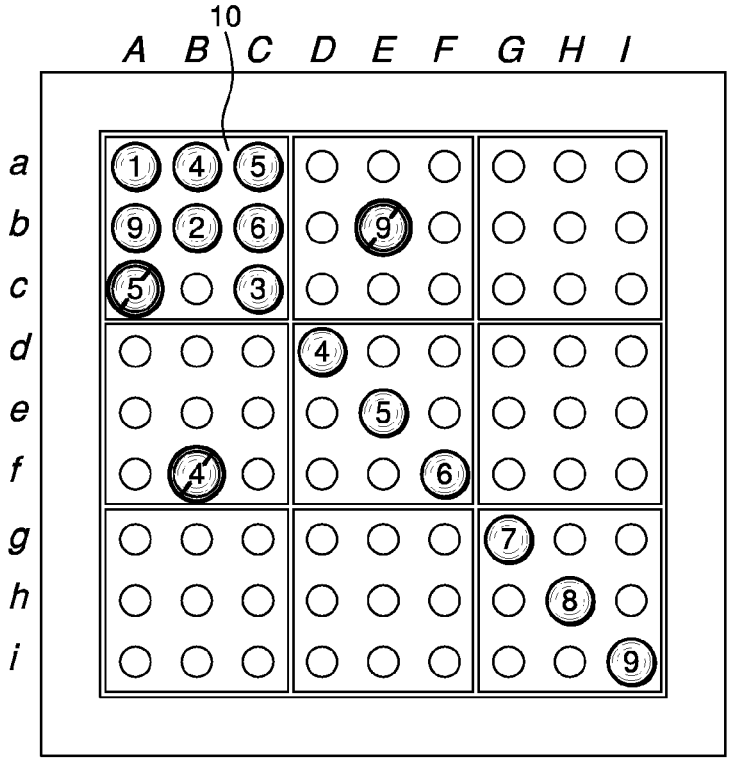
FIG. 3 is an illustration of the game board of FIG. 2B showing both proper marker placements and improper marker placements.

Referring to FIG. 3, the game board 100 is shown initialized for play by placing nine distinct markers in a diagonal, as described above with reference to FIG. 2B. The game board 100 further shows several markers placed as follows: a yellow marker in receptacle (B, a), a green marker in receptacle (C, a), a black marker in receptacle (A, b), and an aqua marker placed in receptacle (C, b). To illustrate the first rule of the game, a player may not place a black marker, a red marker, or an aqua marker in any receptacle in the second horizontal row (b). Therefore, a player placing a black marker in receptacle (E, a) violates the rule that only one distinct marker may be placed in each row. Nor may a player place a yellow marker or a red marker in any receptacle in the second vertical row (B). Therefore, a player placing a yellow marker in receptacle (B, f) violates the rule that only one distinct marker may be placed in each column. In 3×3 box 10, a player may only place a blue or a purple marker in the two remaining vacant receptacles (A, c) and (B, c). Therefore, a player placing a green marker in receptacle (A, c) violates the rule that only one distinct marker may be placed in each 3×3 box. It should be noted that either a blue or purple marker may be placed in either vacant receptacle, as neither of these placements would violate the rule that only one distinct marker may be placed in each row, column, or 3×3 box.

The player who plays all of their markers first wins the game. If no player is able to play all of their markers, the player with the fewest markers remaining is the winner. If more than one player has the fewest number of markers remaining, the player who played their markers in the fewest number of rounds is deemed the winner. If a tie still exists, the player with the fewest number of colors remaining is the winner. The game results in a tie if the players have played the same number of markers in the same number of rounds and the same number of colors remaining. In determining the winner, the term 'round' means each player's turn plus any extra turns awarded for completion of row, column, or 3×3 box, in accordance with rule 3.

In a second embodiment of the present invention, a turn based, multiplayer cooperative board game is disclosed. Preferably, the amount and type of communication between the players is limited or restricted altogether. In this manner, communication and team-working skills may be developed. Each group of players determines the level of communication allowed to achieve the goal of placing all eighty one (81) markers on the game board. Communication can vary from none at all, to solely body language, to an open discussion, as desired. By varying the level of communication, the same group of players can face different teamwork challenges with each game.

The board is initialized in the same manner as described above with reference to FIGS. 2A, 2B, and 2C. The remaining 72 markers are collected in a pool visible to all players. The first player is preferably chosen by consensus, or by selecting one stone blind from the pool, lowest number going first, as described above. The object of the board game of this embodiment is to place all 81 markers on the board so that each row, column, and 3×3 box has exactly one of each distinct marker.

The first player chooses one stone from the pool and places it on the board. Only one distinct marker may be played in any horizontal row, vertical column, or 3×3 box. Play then proceeds to the next player. As play proceeds, care must be taken not only to avoid placing a marker in a row, column, or 3×3 box of an identical marker, but also that the placement of a marker does not force a later impasse.

If any player notices that any of the markers already placed on the game board prevents the object of the game from being achieved, the player may use their turn to remove the offending marker to the pool. Where the players of the game have permitted verbal communication, the player may wish to explain why the offending stone would prevent placement of all 81 stones on the board. Play then proceeds until all eighty one (81) of the stones are placed on the game board according to the rules of the game.

Besides a player explaining why a particular stone must be removed, the mode and extent that team players may communicate is best left to the consensus of the players. This will vary according to the relative skill, experience, and personalities of the individual players, and also the context in which the game is being played, for example a party, a work training session, or a schoolroom.

While the board game of this second embodiment is not competitive in the traditional sense, a team could measure its performance against other teams or its own previous efforts using the following very simple scoring system. Since 72 correct placements are required to meet the object of the game, 72 is the perfect score. One point is added for each removal of a stone, whether that removal was necessary or ill-advised.

Figure 6:
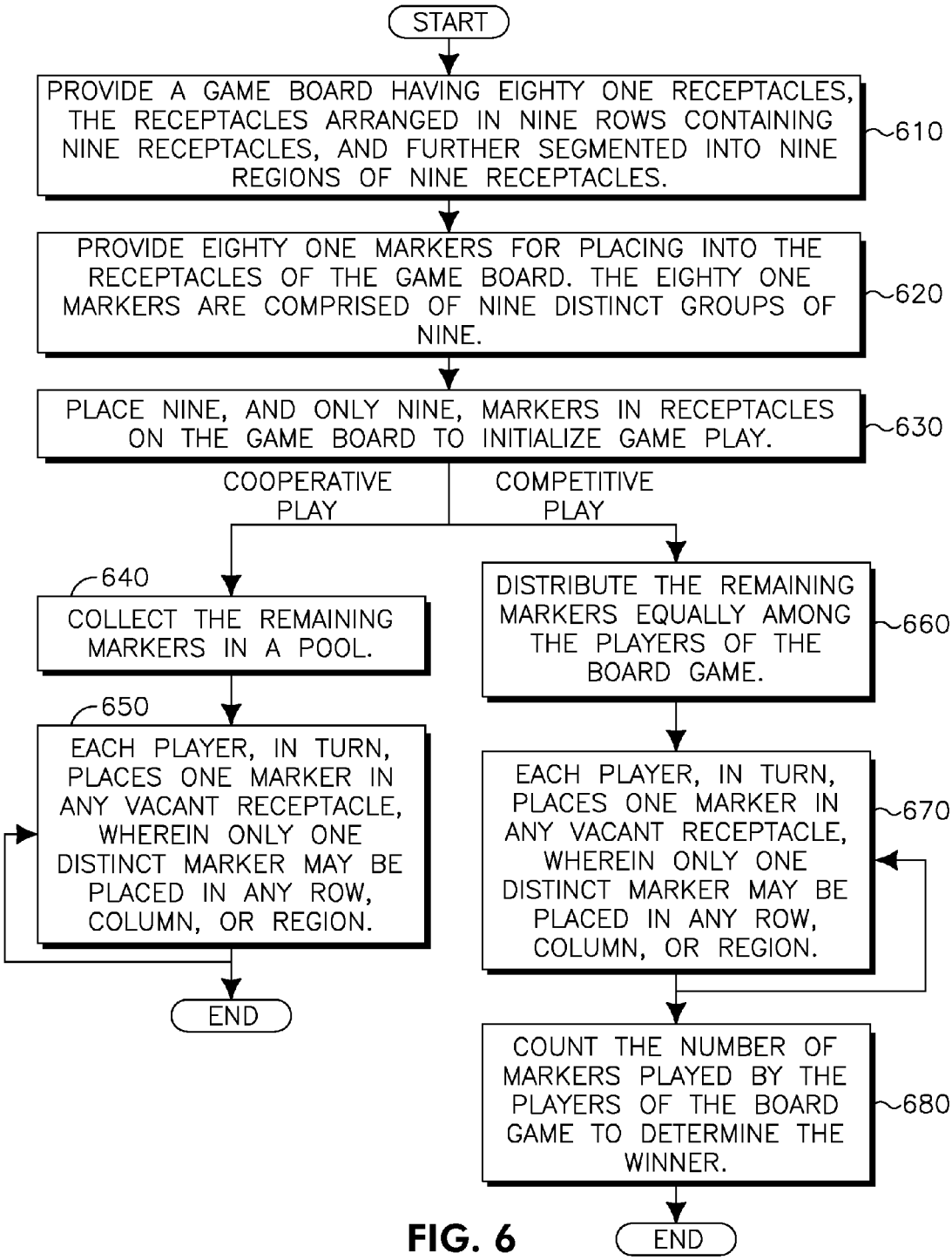
FIG. 6 is a method flow diagram of a method for playing the board game of the present invention in both a cooperative manner, in accordance with a first embodiment, and a competitive manner, in accordance with a second embodiment.

Referring to FIG. 6, a method 600 for playing the board game of the present invention begins with providing a game board having eighty one receptacles, the receptacles arranged in nine rows containing nine receptacles, and further segmented into nine regions of nine receptacles, such as, for example, the game board of FIG. 1 (step 610). Next, eighty one markers are provided for placing into the receptacles of the game board (step 620). The eighty one markers are comprised of nine distinct groups of nine, such as, for example, nine distinct colors. To initialize game play, nine and only nine markers are placed in receptacles on the game board (step 630). For example, the markers may be placed on the game board as shown in FIGS. 2A, 2B, 2C, and 4.

In one embodiment for cooperative game play, the remaining markers are collected in a pool (step 640). Then, each player, in turn, places one marker in any vacant receptacle, wherein only one distinct marker may be placed in any row, column, or region of the game board (as shown and described with reference to FIG. 3) (step 650). This is repeated until there are no more markers in the pool.

In another embodiment for competitive game play, after game board initialization in step 630, the remaining markers are distributed equally among the players of the board game (step 660). Then, each player, in turn, places one marker in any vacant receptacle, wherein only one distinct marker may be placed in any row, column, or region (as shown and described with reference to FIG. 3) (step 670). This is repeated until no marker can be placed without violating the rule of one distinct marker in any row, column, or region. A winner is determined by counting the number of markers played by each player of the board game (step 680).

Figure 4:
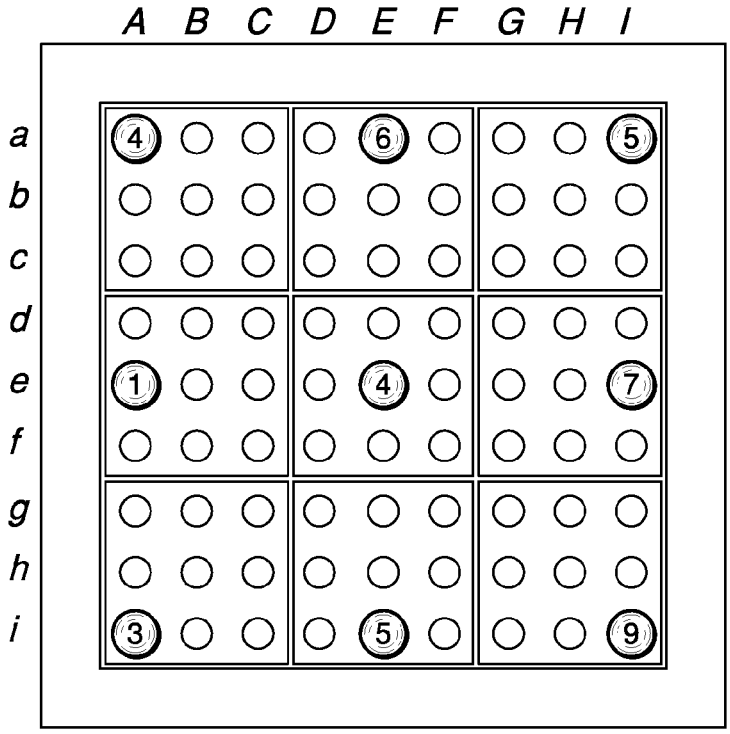
FIG. 4 is an illustration of the game board of FIG. 1 initialized for game play by placing distinctive markers in the positions shown according to a third embodiment of the present invention.

Referring to FIG. 4, in a third embodiment, which is a variation of the second embodiment previously described, the board game is initialized by randomly choosing nine markers and placing them in the following receptacles on the game board: (A, a), (E, a), (I, a), (A, e), (E, e), (I, e), (A, i), (E, i), and (I, i). As shown in FIG. 4, several markers of the same group are randomly selected and placed on the game board in the above order. If any of the randomly selected markers violates the rule of only one of each distinct marker in any row, column, or 3×3 box, then that marker is returned to the pool and another is selected.

In a fourth embodiment, a player initializes the game board according to a predetermined arrangement, such as purely by way of example, a player's favorite Sudoku puzzle. Each number of a typical Sudoku puzzles is assigned to a group of distinct markers. Preferably, the markers are distinguished by color, however, any distinguishing feature may be used. Using colors rather than numbers offers a unique challenge. Alternatively, two players may cooperatively solve the puzzle. Only one distinct marker may be placed in any horizontal row, vertical column, or 3×3 box on the game board. Preferably, the predetermined arrangement of the markers for initializing game play results in the appearance of the colors of the spectrum. Alternatively, the colors of the spectrum may appear when the puzzle is solved.

Figure 5:
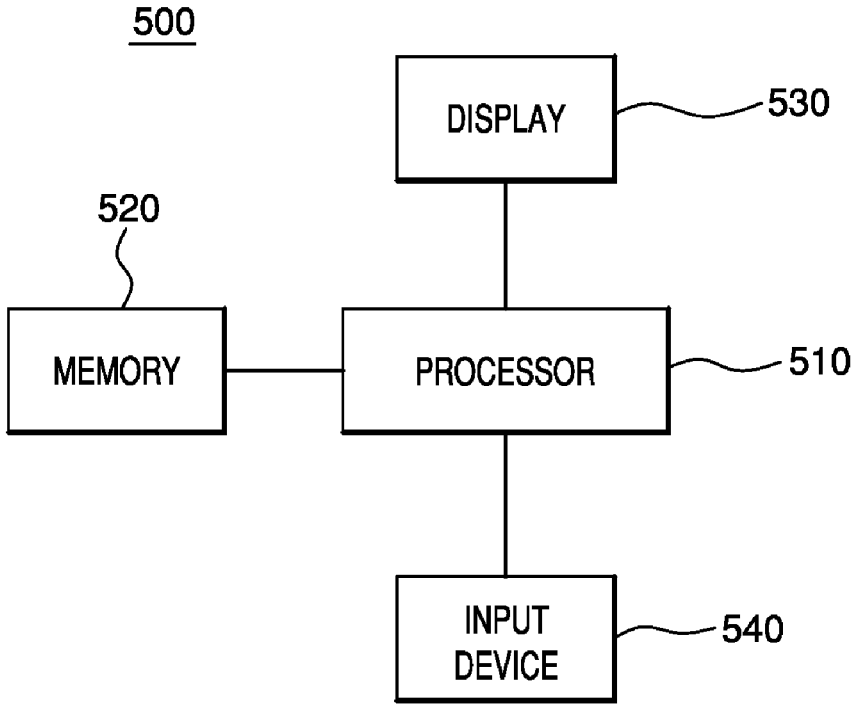
FIG. 5 is a block diagram of an electronic device for implementing the board game of the present invention.

The present invention may also be implemented by an electronic device, such as a computer, by way of computer executable software code. Referring to FIG. 5, an electronic device 500 for implementing the board game of the present invention is shown. A processor 510 is configured to execute software code stored in memory 520. A display 530, preferably a graphical user interface (GUI), displays the game board to a player. A player uses input device 540 to manipulate and place markers represented graphically on the display 530. Where the electronic device 500 is a personal computer, the input device 540 is preferably a keyboard or a mouse. Where the electronic device 500 is a stand-alone game unit, the input device 540 may be action keys, or the display 530 may incorporate a pressure sensitive touch screen. The distinctive markers may be represented graphically on the display 530 using icons. Players would interface with the electronic board via a user interface. Selection of markers and locations for a player's turn may be selected by way of the user interface.

The present invention can be implemented in a computer program tangibly embodied in a computer-readable storage medium containing a set of instructions for execution by a processor or a general purpose computer; and method steps of the invention can be performed by a processor executing a program of instructions to perform functions of the invention by operating on input data and generating output data. Suitable processors include, by way of example, both general and special purpose processors. Typically, a processor will receive instructions and data from a ROM, a random access memory (RAM), and/or a storage device. Storage devices suitable for embodying computer program instructions and data include all forms of non-volatile memory, including by way of example semiconductor memory devices, magnetic media such as internal hard disks and removable disks, magneto-optical media, and optical media such as CD-ROM disks and digital versatile disks (DVDs). In addition, while the illustrative embodiments may be implemented in computer software, the functions within the illustrative embodiments may alternatively be embodied in part or in whole using hardware components such as Application Specific Integrated Circuits (ASICs), Field Programmable Gate Arrays (FPGAs), or other hardware, or in some combination of hardware components and software components.

Although the features and elements of the present invention are described in the preferred embodiments in particular combinations, each feature or element can be used alone without the other features and elements of the preferred embodiments or in various combinations with or without other features and elements of the present invention.

What is claimed is:

1. A method of competitively playing a board game by a plurality of players, the method comprising:

providing a game board having eighty one receptacles, the receptacles arranged in nine rows, each row containing nine receptacles, and the game board further segmented into nine regions of nine receptacles;

providing eighty one markers for placing into the receptacles of the game board, wherein the eighty one markers are comprised of nine distinct groups of nine;

placing nine, and only nine, markers in receptacles on the game board to initialize game play, wherein each of the markers placed on the game board to initialize game play is selected from a different one of the nine distinct groups of nine and is not moved from a receptacle in which it was placed;

distributing the remaining markers equally among the plurality of players;

placing by the plurality of players, in turn, one marker in any vacant receptacle, wherein only one distinct marker may be placed in any row, column, or region; and counting the number of markers played by each player wherein a winner is the player who plays the most markers.

2. The method of claim 1, wherein the markers are distinguished by color.

3. The method of claim 2, wherein the colors are clear, red, orange, yellow, green, aqua, blue, purple, and black.

4. The method of claim 1, wherein the markers are stones.

5. The method of claim 1, wherein if a player places a marker that completes a row, column, or region, the player receives an extra turn for each row, column, or region completed.

6. The method of claim 1, wherein if a player places a marker on the game board that is not distinct within its row, column, or region, the marker is removed from the game board, returned to the player, and the player loses a turn.

7. The method of claim 1, wherein one of each group of distinct markers is placed in a single row, a single column, or a diagonal line to initialize game play.

8. The method of claim 1, wherein the game board is initialized by placing a marker in each corner receptacle of the game board, a marker in each receptacle located equidistant from the corners on the periphery of the game board, and one marker in the center receptacle of the game board wherein no two identical markers are placed in the same row or column.

9. The method of claim 1, wherein the board game is implemented in an electronic device.

10. A computer-readable storage medium containing instructions for a general purpose computer, the instructions comprising:

a first code segment for providing a game board having eighty one receptacles for a plurality of players to play a competitive board game, the receptacles arranged in nine rows and nine columns, and the receptacles further grouped into a plurality of predetermined regions;

a second code segment for providing eighty one markers, for placing into the receptacles of the game board, wherein the markers comprise nine groups of identical markers and each of the nine groups is a type of distinct marker;

a third code segment for initializing the game board by placing nine, and only nine, markers in receptacles on the game board, wherein each of the markers is a different one of the types of distinct markers and is not moved from a receptacle in which it was placed;

a fourth code segment for distributing the remaining markers equally among the plurality of players;

a fifth code segment enabling the plurality of players to place in turn, a marker in any vacant receptacle, wherein only one type of distinct marker may be placed in any row, column, or predetermined region; and a sixth code segment for determining a winner by counting the number of markers played by each player wherein a winner is the player who played the most markers.

* * * * *